United States Patent [19]

Winey

[11] Patent Number: 4,471,173

[45] Date of Patent: Sep. 11, 1984

[54] PISTON-DIAPHRAGM SPEAKER

[75] Inventor: James M. Winey, White Bear Lake, Minn.

[73] Assignee: Magnepan, Inc., White Bear Lake, Minn.

[21] Appl. No.: 353,848

[22] Filed: Mar. 1, 1982

[51] Int. Cl.[3] ..... H04R 9/00

[52] U.S. Cl. ..... 179/115.5 PV; 181/170

[58] Field of Search ..... 179/115.5 PV, 115.5 ES, 179/115.5 VC, 115.5 DV, 115.5 R; 181/170, 173

[56] References Cited

U.S. PATENT DOCUMENTS

| | | | |
|---|---|---|---|
| 3,674,946 | 7/1972 | Winey | 179/115.5 PV |
| 3,829,623 | 8/1974 | Willis | 179/115.5 PV |
| 3,833,771 | 9/1974 | Collinson | 179/115.5 PV |
| 3,922,502 | 11/1975 | Tabuchi | 179/115.5 PV |
| 3,922,503 | 11/1975 | Tabuchi | 179/115.5 PV |
| 4,242,541 | 12/1980 | Ando | 179/115.5 PV |

FOREIGN PATENT DOCUMENTS

| | | | |
|---|---|---|---|
| 456570 | 4/1926 | Fed. Rep. of Germany | 179/115.5 PV |
| 2461258 | 1/1976 | Fed. Rep. of Germany | 179/115.5 PV |
| 52-20013 | 2/1977 | Japan | 179/115.5 PV |
| 52-38915 | 3/1977 | Japan | 179/115.5 PV |
| 52-43419 | 4/1977 | Japan | 179/115.5 PV |
| 57-65996 | 4/1982 | Japan | 179/115.5 PV |
| 1443491 | 7/1976 | United Kingdom | 179/115.5 PV |

OTHER PUBLICATIONS

S. Rich, "Electrodynamic Loudspeaker . . . ," *Electronics*, Jun. 11, 1961.

*Primary Examiner*—Gene Z. Rubinson
*Assistant Examiner*—L. C. Schroeder
*Attorney, Agent, or Firm*—Peterson, Palmatier, Sturm, Sjoquist & Baker, Ltd.

[57] ABSTRACT

A planar diaphragm type magnetic transducer with an acoustically transparent magnetic backing, and a diaphragm overlying and spaced from the magnetic backing, the magnetic backing having magnetized strips lying parallel to each other and adjacent magnetized strips having opposite polarities at their faces confronting the diaphragm, the diaphragm being stiff and resisting flexing and connected by a flexible surround at its periphery.

28 Claims, 18 Drawing Figures

PISTON-DIAPHRAGM SPEAKER

This invention relates to planar diaphragm type magnetic transducers or loud speakers.

BACKGROUND OF THE INVENTION

A diaphragm type magnetic transducer or loud speaker must have certain basic components including a diaphragm with a vibratable area to which signal conducting conductors are secured. The conductors may be round wire, or may be foil, or may be metallic film etched away into conductor shaped strips. The transducer must also include a source of magnetic fields which project to the diaphragm so that the runs of conductor wire are embraced in the magnetic field such that when an audio frequency signal is applied to the conductor, the vibratable area of the diaphragm will vibrate in synchronism with the frequency of the signal applied and produce sounds with the desired magnitude and frequency.

Typically, a magnetic backing adjacent the diaphragm is the source of the magnetic field and has an apertured soft iron plate spaced from the diaphragm and carrying a multiplicity of elongate magnet strips spaced from each other and laid upon the plate. The magnetized strips are related to one another so that their magnetic field will project from the faces of the magnetized strips to the diaphragm and conductors thereon.

Typical diaphragm type magnetic speakers have been illustrated and described in detail in prior U.S. Pat. No. 3,674,946 and 3,929,499. In the earlier patent, the magnetized strips were parts of a panel or sheet of magnetic matieral; and in the later patent; the magnetized strips were physically shaped as strips of the magnetic material. Accordingly, it is clear that such magnetized strips may take various forms.

All of the known prior diaphragm type magnetic speakers have used diaphragms of film type material which are anchored securely around their peripheries to the frame which is rigid with the magnetic backing. In many such transducers, the diaphragm is stretched very tight, but within the elastic limits of the film material. In some instances, the film type diaphragm has been left rather loose. However, in the prior art, the vibratable areas of the diaphragm in such speakers have consistently been caused to flex by reason of the interrelated function of the signal currents flowing through the wires on the diaphragm, together with the magnetic fields produced by the magnetized strips in the magnetic backing. The central portions of the vibratable areas have a very significant movement or excursion away from the normal position in response to the application of signal current in the conductors; but on the other hand, the edge portions of the vibratable areas have remained essentially stationary. As a result, the central portions of the vibratable areas contributes more to the production of sound as compared to the edge portions. Therefore, because the sounds produced in the bass and mid-range frequencies are produced mainly by the central portions of the diaphragm, there is a definite limitation on the magnitude of sounds produced.

SUMMARY OF THE INVENTION

An object of the invention is to provide a novel planar diaphragm type magnetic transducer which improves the magnitude of sound output in the bass frequencies.

A feature of the present invention is the provision, in a diaphragm type magnetic speaker, of a diaphragm having a vibratable area which is stiff or substantially rigid and which is secured at its periphery by a surround or flexible joint to the rigid peripheral frame. The substantially rigid vibratable area carries conductors in runs spaced from each other substantially entirely across its length and breadth. The substantially rigid vibratable area of the diaphragm may be formed of any of a number of different materials with a high stiffness to weight ratio and low density. Typical of the materials may be molded fibrous pulp, a paper-like material with considerable stiffness; molded styrofoam in slabs with considerable thickness and which may be honeycombed with numerous strengthening ribs or webs and recesses therebetween. Sectional thickness of the styrofoam may be in the range of 0.030 to 0.060 inches. Fibrous pulp may also be shaped or molded into a honeycomb shape for lightness and strength. Also, balsa wood may be fabricated or built up or otherwise shaped into a stiff slab to provide the vibratable area of the diaphragm. Certain expanded bead technology materials with carbon fibers, or other carbon fiber material, may also be used in the substantially rigid vibratable area of the diaphragm. In using certain of these materials, the vibratable area of the diaphragm may be molded, fabricated or built up; and certain of these materials may be utilized together for lightness and strength. Of course, the surround may be formed of material which is identical to or different than the substantially rigid material in the vibratable area of the diaphragm, and the surround may be integral and in one piece with the vibratable area or may be a separate piece of material and secured to the vibratable area.

The particular advantages obtained through the use of the present invention in a planar type magnetic transducer is to increase the power handling of the transducer for the bass frequencies, thereby producing substantially greater magnitude of sound output in the bass and midrange frequencies. The entire vibratable area of the diaphragm, from edge to edge and from end to end, will have essentially the same vibrating movement, toward and away from the magnetized strips behind the diaphragm. As a result, substantially more sound power output can be obtained in the bass frequencies than with the previously known speakers which rely on flexing of the diaphragm.

With this stiff vibratable area type diaphragm, conductors may be arranged on the diaphragm in numerous ways; and various magnetic circuits may be utilized which are especially adapted for use with this type of diaphragm.

The conductors on the diaphragm may be laid side by side, and the width of the bands of conductors in the runs may be either narrow or may be sufficiently wide as to exceed the spacing width between adjacent magnetized strips in the magnetic backing. The wide bands of conductors may traverse the entire front faces of adjacent magnetized strips of opposite polarity. The conductors may also be stacked one upon each other and adhesively held together in the conductor runs so that the stacked conductor runs have considerable depth in a direction normal to the plane of the diaphragm. In certain instances, these stacked conductors may be incorporated or molded directly onto the ribs or honeycomb shape of certain of the rigid vibratable areas. These stacked conductors provide ribbing to add to the stiffness of the diaphragm, and also add more power handling capabilities to the transducer for increasing the output in the bass frequencies.

Also, the rigid vibratable area type diaphragm may be used between confronting magnetic backings with opposed fields with the diaphragm sandwiched therebetween so that conductors on the diaphragm are influenced by magnetic fields originating from both sides of the diaphragm. The opposed fields causes flattening of the magnetic fields so that the line of magnetic flux lie parallel to the diaphragm, as to optimize the forces produced on the diaphragm for vibrating it in the bass frequencies.

It is also particularly useful to use an improved magnetic circuit in the magnetic backing so that the magnetic field produced by the magnet strips will be intensified at the diaphragm.

A BRIEF DESCRIPTION OF THE DRAWINGS

FIG. 18 is a detail plan view of an alternate form of magnet sheet which may be substituted for the strips illustrated in the other views.

DETAILED SPECIFICATION

Figure 1:
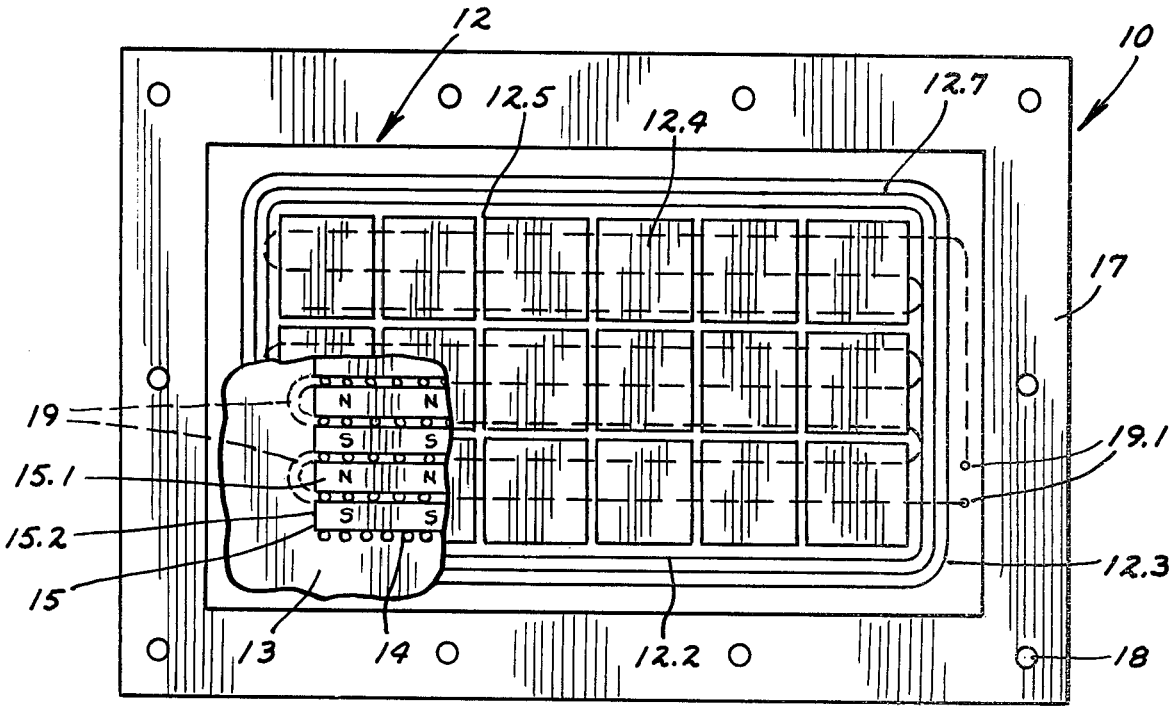
FIG. 1 is an elevation view of a typical diaphragm type magnetic transducer or speaker incorporating the present invention, the figure being partly broken away for clarity of detail.
Figure 2:
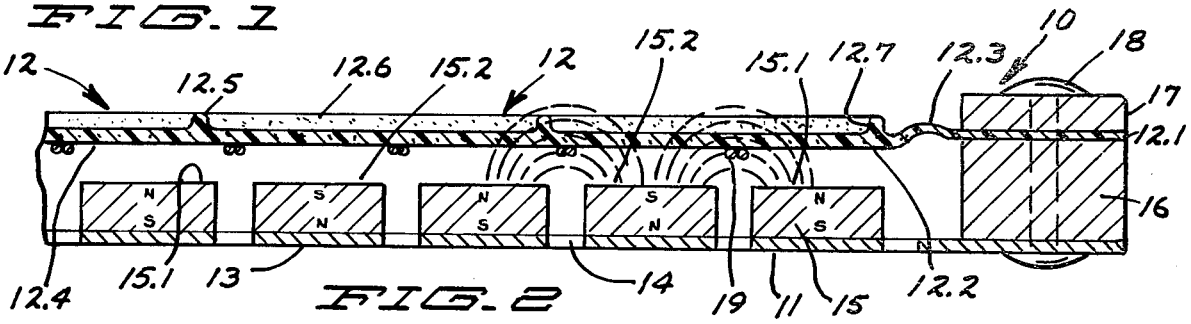
FIG. 2 is an enlarged detail section view taken approximately at 2—2 of FIG. 1.
Figure 13:
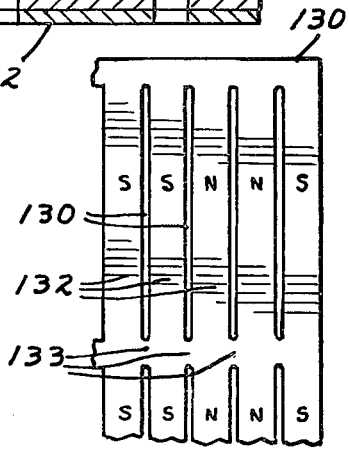
FIG. 13 is an elevation view of a speaker of somewhat different shape and embodying the invention.
Figure 13:
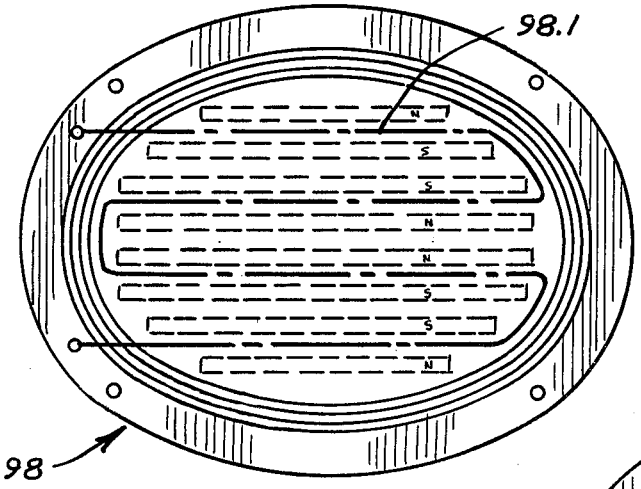
Figure 14:
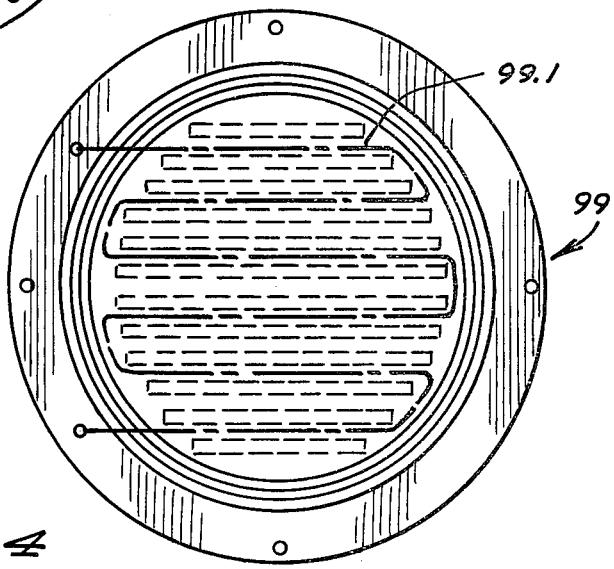
FIG. 14 is an elevation view of still another speaker of different shape embodying the present invention.

One form of the invention is illustrated in FIGS. 1 and 2 wherein the rectangular transducer is indicated in general by the numeral 10. The transducer has an acoustically transparent magnetic backing 11 and a diaphragm 12. The transducer 10 may be in any of a wide range of sizes and shapes, and may in some instances have proportions of approximately 9 inches long by 6 inches wide or smaller, or the transducer may have a considerably longer shape, such as in the range of 36 to 48 inches or more, while the width may be up to 9 or 12 inches wide. Alternatively, the transducer may be round, down to three inches in diameter or smaller, or may have different shapes as illustrated in FIGS. 13 and 14.

The magnetic backing 11 includes a soft iron magnetic plate or armature 13 having a multiplicity of openings or apertures 14 therein for the purpose of making the magnetic backing 11 acoustically transparent.

Figure 12:
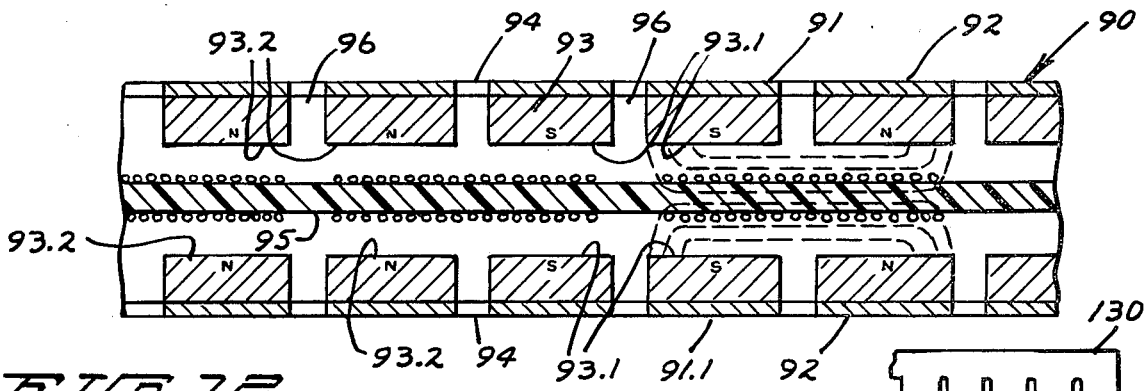
FIG. 12 is a detail section view of one additional modified form of the invention.

The magnetic backing also has a multiplicity of elongate magnetized strips 15 which are regularly spaced from each other, as illustrated, but could be in other physical arrangements relative to each other, such as illustrated in FIGS. 12 and 18. The magnetized strips 15 lie between the apertures 14 so as to minimize interference with the openings of the apertures and thereby minimize acoustical loading on the transducer.

The backing includes a rigid spacer or frame strip 16 extending entirely around the outer periphery of the plate 13 and cooperating with another similar strip 17 in clamping and securing the peripheral edge 12.1 of the diaphragm therebetween. The strips 16 and 17 are rigidly affixed to the back plate 13 by mechanical fasteners such as rivets 18. Althrough the strips 16 and 17 may be made of steel, the material in these peripheral strips 16 and 17 is not critical.

The magnetized strips 15 are formed of any of a number of different materials and may typically be formed of a rubber bonded barium ferrite known by its trademark "Plastiform" of 3M Company, St. Paul, Minn. The magnetized strips 15 are magnetized in a direction perpendicular to the plate 13 and to the diaphragm 12 so as to define magnetic poles at their front faces. It will be recognized that front faces 15.1 of the magnetized strips are polarized with a north pole all along the lengths thereof, and the front faces 15.2 are polarized with a south pole all along the lengths thereof.

Figure 4:
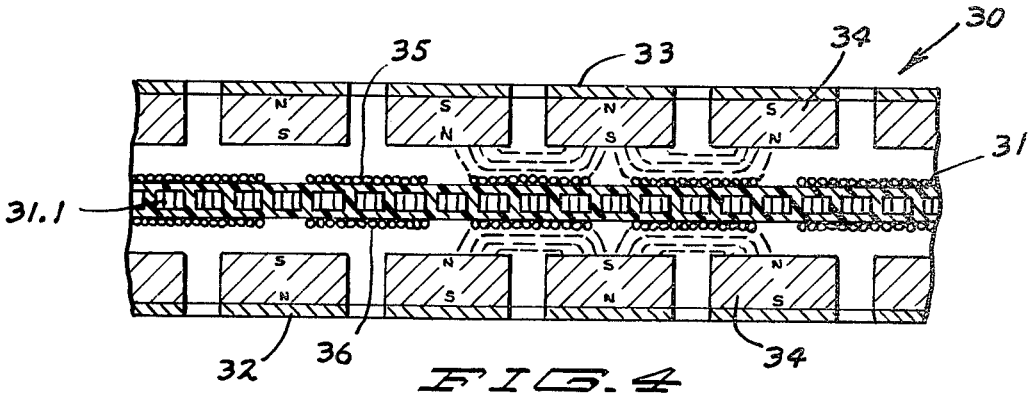
FIG. 4 is a detail section view showing a second modified form of the invention.

In certain instances, it may be desirable to form the magnetized strips 15 of material for producing a more intense magnetic field, or a greater flux density at the diaphragm, in which case such materials such as samarium cobalt or other rare earth materials as ceramic magnets may be used. Also, a different magnetic circuit may be used, as illustrated in FIG. 12. Using opposed magnetic backings on opposite sides of the diaphragm, as illustrated in FIGS. 4 and 12, also intensifies the magnetic field at the diaphragm.

The diaphragm 12 has a stiff and substantially rigid vibratable area 12.2 with a size to confront substantially the entire magnetic backing 11 and especially to confront all of the magnet strips 15 thereof.

The diaphragm may be formed of various materials having a high stiffness to weight ratio and a low density so as to vibrate at most of the frequencies which are considered to be within the audio frequency range. It is expected in most cases that the vibratable area of the diaphragm will vibrate within the frequency range of approximately 20 cycles per second up to 15,000 cycles per second, and in some instances, the vibratable area may vibrate up to 20,000 cycles per second.

The diaphragm 12 may be formed entirely of one material, or it may be that the substantially rigid vibratable area may be formed of one material including the surround or flexible joint 12.3, or in some instances the surround and outer periphery 12.1 may be formed of a separate material and connected to the vibratable area.

Figure 5:
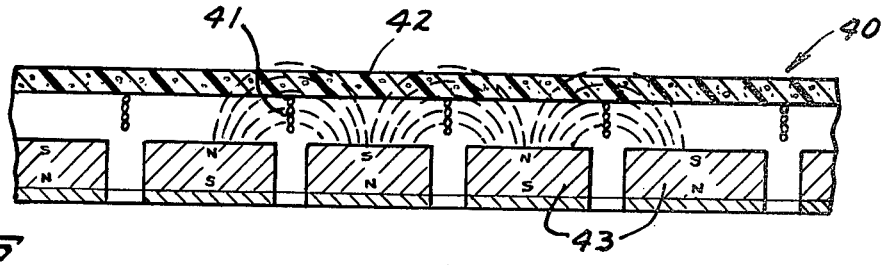
FIG. 5 is a detail section view showing another modified form of the invention.
Figure 6:
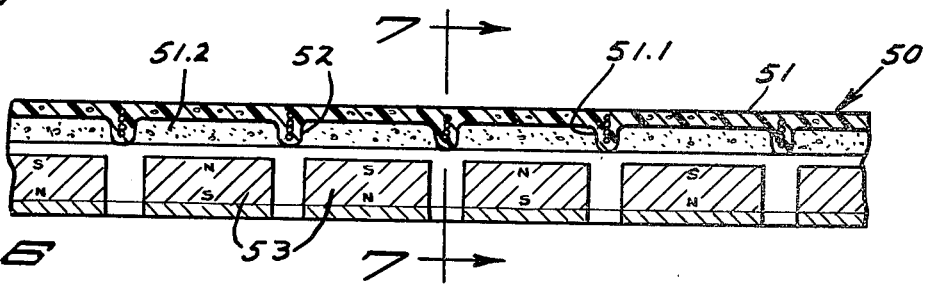
FIG. 6 is a detail section view of another modified form of the invention and taken at 6—6 of FIG. 7.
Figure 11:
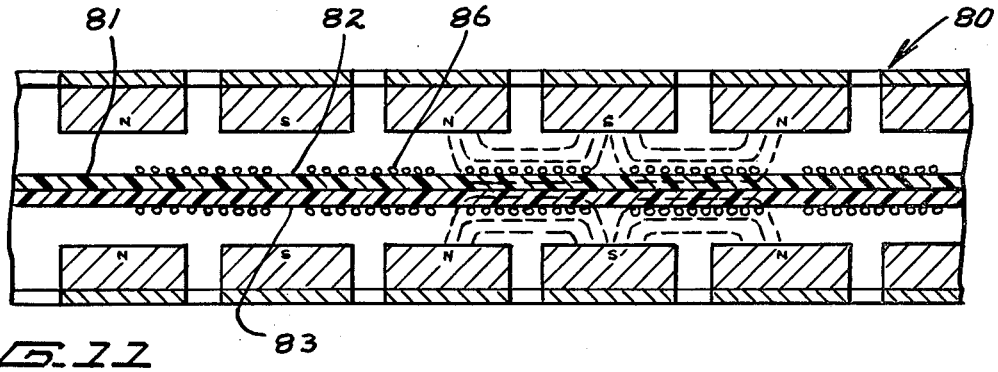
FIG. 11 is a detail section view of one more modified form of the invention.

Typically, the diaphragm may be formed of a fibrous pulp, a paper-like material which can be readily molded into the desired shape. Otherwise, the diaphragm may be formed of a styrofoam or of a carbon fiber type of material or a combination of various materials to provide the requisite lightness and stiffness and durability. The diaphragm may be molded or fabricated or built up of several distinct parts and adhesively or otherwise secured together. In many instances, it is desirable that the vibratable area 12.2 of the diaphragm be shaped as a honeycomb, as illustrated in FIG. 4, and preferably the area 12.2 has a flat bottom panel 12.4 lying substantially in a plane and confronting the magnetic backing 11. Integrally formed ribs 12.5 and 12.6 extend in transverse directions relative to each other and are integrally molded with respect to each other will provide significant stiffness to the vibratable area. The vibratable area may have a peripheral rib or a rim 12.7 adjoining the surround 12.3 for adding stiffness and providing a secure connection to the surround. In some instances, depending upon the nature of the material used in the vibratable area of the diaphragm, the vibratable area may be a simple slab of finite thickness, as illustrated in FIG. 5. In other instances, the diaphragm may be fabricated somewhat as illustrated in FIG. 11 with a honeycombed shape, together with a second panel overlying and concealing the honeycombs. Otherwise the vibratable area of the diaphragm may be fabricated, substantially as illustrated in FIG. 6 wherein the strands of the conductor runs are embedded in the ribs of the diaphragm.

In FIGS. 1 and 2, the vibratable area of the diaphragm has a number of conductor runs 10 secured onto the flat surface of the bottom panel 12.4. The conductor runs 19 each have a multiplicity of conductor strands therein, which are in the magnetic fields created by the magnet strips. The conductor runs 19 are regularly spaced from each other across the width of the vibratable area and each of the runs is located in the magnetic field produced by one pair of the magnetized strips 15. The magnetized strips 15 and the conductor run 19 have approximately the same length. The conductors may have a size to carry the necessary signal current, and are typically in the size range of 24 to 32 gauge.

When an audio frequency electrical signal current is applied to the conductor runs, as at the terminals 19.1, the vibratable area 12.2 of the diaphragm vibrates or oscillates toward and away from the magnetic backing 11, thereby producing a sound which has the same pitch and frequency as the frequency of the signal current being applied. The surround 12.3 will yeild while the entire width and length of the substantially rigid vibratable area 12.2 moves under influence of the cooperating signal current and magnetic fields. All parts of the vibratable area of the diaphragm have essentially the same motion. As a result, an improved efficiency in the transducer is achieved and more power output from the transducer is possible, thereby obtaining sounds of larger volume than has been heretofore known, especially in the bass and midrange audio frequencies.

Figure 3:
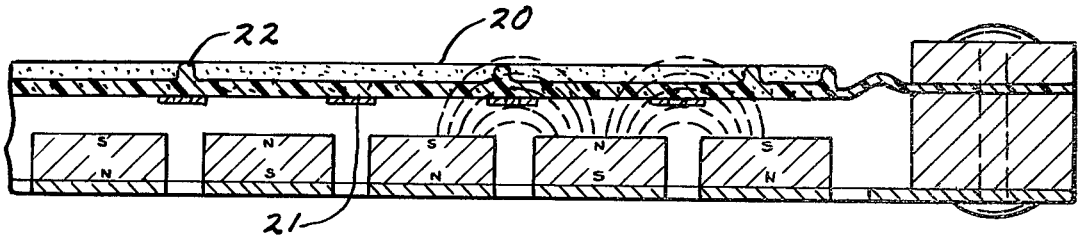
FIG. 3 is an enlarged detail section view showing a modified form of the invention.

In the form of transducer 20 seen in FIG. 3, the transducer is essentially the same as that disclosed in FIGS. 1 and 2 with the exception that the conductor runs do not incorporate round wire strands as in FIGS. 1 and 2, but the conductor runs 21 are formed of conductor strands which are essentially flat in cross section and are made of strips of foil applied to the diaphragm 22 and adhesively secured thereto. The flat conductor strands may also be formed by applying a metal coating to the diaphragm and then etching away portions to define the individual strands. The functioning of the form illustrated in FIG. 3 is essentially the same as that of FIGS. 1 and 2. The foil may be up to 0.010 inches thick, or more, to carry the desired signal current. The individual strands are insulated from each other by a space which may have a width with the same order of magnitude as the thickness of the foil.

In FIG. 4, the transducer 30 has a substantially rigid diaphragm 31, which in this form is in the shape of a simple slab of low density material having a honeycomb structure with numerous cells or openings 31.1 therein. This diaphragm is made of light weight plastic so as to have a high stiffness to weight ratio. Alternately, the diaphragm may be of styrofoam or other stiff light weight material such as a rigid slab of balsa wood or similar material. In this form, the magnetic backing 32 is essentially identical to the backing 11 of FIGS. 1 and 2; and a second substantially identical magnetic backing 33 is incorporated and placed opposite the magnetic backing 32 and cooperating therewith in sandwiching the vibratable area of the diaphragm therebetween. Both of the magnetic backings 32 and 33 are spaced from the diaphragm and acoustically transparent and incorporate magnet strips 34, as previously described. In the backings 32 and 33, magnetized strips of like polarity confront each other. The conductor runs 35 and 36 are applied onto the open faces of the diaphragm 31. Alternately, one set of conductor runs may be omitted, depending upon power requirements.

In this form of the invention of FIG. 4, the functioning is nearly the same as in FIGS. 1 and 2 with the exception that the magnetic fields are created at both sides of the diaphragm to effectively produce an extremely flat magnetic field at the diaphragm due to the interaction of the magnetic fields. This flat field optimizes the forces applied for vibrating the diaphragm. Again, the substantially rigid vibratable area of the diaphragm has substantially the same movement in all portions thereof.

In FIG. 5, the transducer 40 is again substantially the same as the transducer 10 of FIGS. 1 and 2 with the exception that the conductor runs 41 on the substantially rigid vibratable area 42 of the diaphragm are arranged with the conductor strands stacked upon each other and adhesively secured together and secured to the face of the diaphragm 42. The stacked strands in the conductor runs 41 may be stacked sufficiently high as to extend substantially to the plane of the faces of the magnetized strips, but aligned with spaces between the adjacent magnet strips 43. The runs 41 extend to and slightly beyond the ends of the magnets, substantially in the manner illustrated in FIG. 1 so that there is no interference between the stacked strands in the conductor runs 41 and the magnetized strips. The stacked conductor runs 41 provide a stiffening effect for the diaphragm as well as providing for increasing the power handling capability of the transducer, especially in the bass frequencies.

Figure 7:
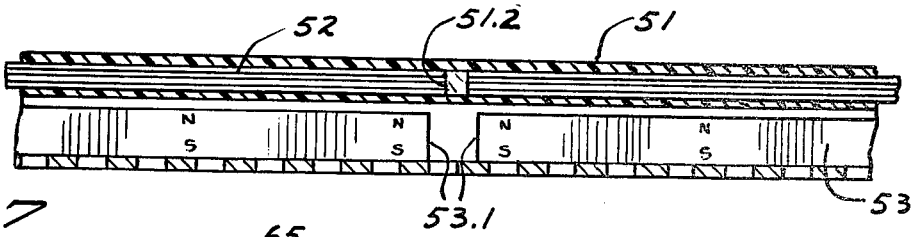
FIG. 7 is a detail section view of the form of the invention illustrated in FIG. 6 and is taken at 7—7 of FIG. 6.

In FIGS. 6 and 7, the transducer 50 has an open honeycombed shaped diaphragm 41 with the conductor runs 52 embedded directly in the ribs 51.1 of the diaphragm. The ribs 51.1 will extend longitudinally of the transducer as a whole and parallel to the magnetized strips 53 so that the ribs may move into and out of the spaces between the magnetized strips. It will be recognized that the diaphragm 51 also has strength ribs 51.2 extending transversely of ribs 51.1 and integrally formed and molded together with the ribs 51.1. The magnetized strips 53 are seen, in FIG. 7, to have spaced ends 53.1 confronting each other midway of the length of the magnetized strips so as to accommodate the transverse strength ribs 51.2 during oscillation of the diaphragm. This form of the invention in FIGS. 6 and 7 provides the advantage of concealing the conductor strands in the ribs and thereby allowing the conductors to contribute to the strength and stiffness of the diaphragm 51, as well as power handling capabilities.

Figure 8:
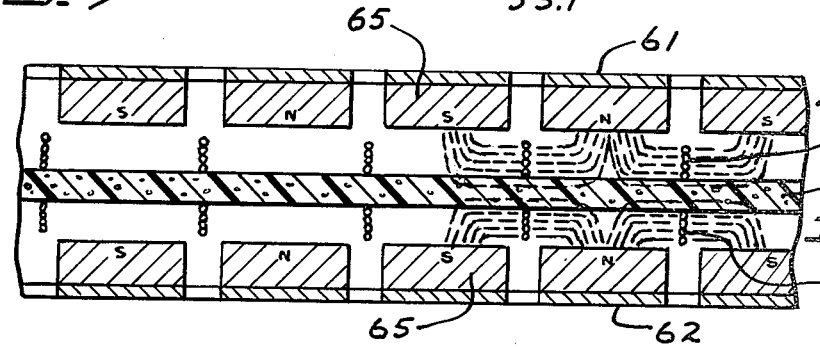
FIG. 8 is an enlarged detail section view of still another form of the invention.

The transducer 60 illustrated in FIG. 8 is very similar to the form of transducer illustrated in FIG. 4 and has a pair of magnetic backings 61 and 62 confronting each other and confronting the diaphragm as to sandwich the diaphragm 63 therebetween. Stacked conductor strands 64 form the conductor runs 63.1 on both sides of the diaphragm 63 and opposite the spaces between the magnetized strips 65 so as not to interfere with the magnetized strips. The stacked conductor strands in the runs 63.1 will contribute to the stiffness of the diaphragm 63, as well as contribute to the production of significant excursion of the diaphragm during application of the signal current.

Figure 9:
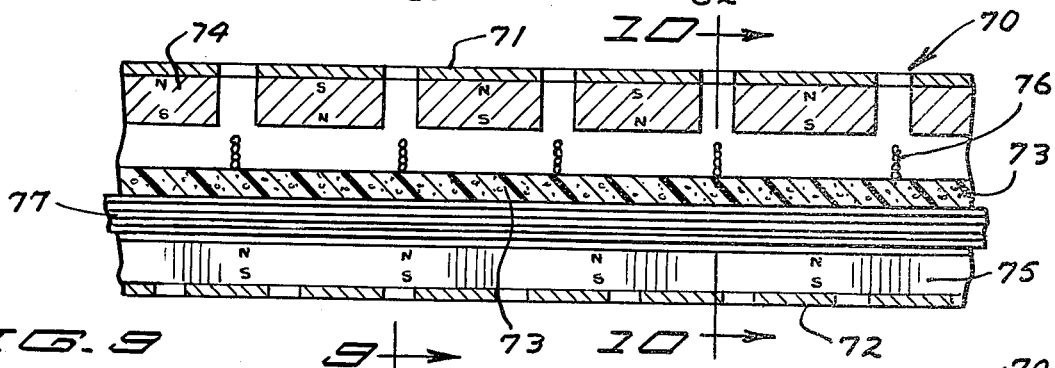
FIG. 9 is an enlarged detail section view of an additional modified form of the invention and is taken at 9—9 of FIG. 10.
Figure 10:
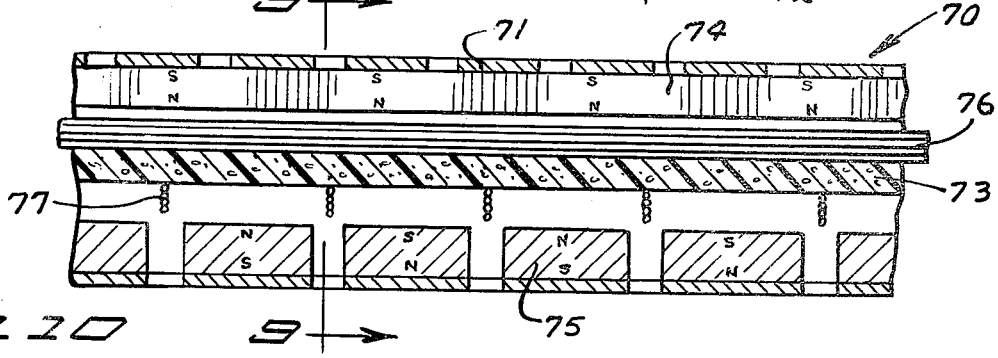
FIG. 10 is a detail section view of the form of the invention illustrated in FIG. 9 and is taken at 10—10 of FIG. 9.

The transducer 70 illustrated in FIGS. 9 and 10 is similar to the transducer 60 of FIG. 8 and has a pair of magnetic backings 71 and 72 disposed opposite each other and sandwiching the diaphragm 73 therebetween. In this form, the magnet strips 74 of the magnetic backing 71 extend transversely as relates to the magnet strips 75 of the opposite magnetic backing 72. Accordingly, the conductor runs 76 on the diaphragm 73 which are adjacent the magnetic backing 71 will extend parallel to the magnet strips 74 and are located in the spaces between the magnet strips to move in these spaces. The stacked conductor strands of conductor runs 77 extend across the face of the diaphragm 73 adjacent the magnetic backing 72, parallel to magnetized strips 75 and in a direction perpendicular or transverse to the direction of conductor runs 76. The magnetic fields from the opposite magnetic backings 71 and 72 in this form of the invention function substantially exclusively in relation to the currents in the respective adjacent conductor runs 76 and 77, respectively, to cooperatively produce the movement of the sound producing vibratable area of the diaphragm.

In FIG. 11, the transducer 80 is substantially the same as transducer 30 of FIG. 4 with the exception of the diaphragm 81 which is fabricated of panels 82 and 83 adhesively affixed together. One or both panels 82, 83 may be ribbed on their abutting faces to provide an overall honeycombed shape, and one panel may be formed with a surround and mounting edge for connection to the frame. The panels carry the conductors 85, 86. The fabricated diaphragm panels 81, 82 increase the rigidity of the diaphragm.

In the transducer 90 of FIG. 12, the transducer is substantially the same as that illustrated in FIG. 4 with the exception that a different and improved magnetic circuit is incorporated into the magnetic backings 91 and 91.1. The soft iron panels 92 have the magnetized strips 93 laid thereon between the apertures 94 and opposite the diaphragm 95. The magnetized strips 93 are arranged so that the magnetized strips have a predetermined sequence of poles at their front faces 93.1 and 93.2, the sequence being a repeated pattern, north, south, south, north, north, south, south, north, et seq. In this magnetic circuit, adjacent functional pairs of magnetized strips 93 which have opposite polarities at their front faces 93.1 and 93.2 cooperate to produce a magnetic field at the diaphragm 95 which has an increased intensity and permits a larger gap between the faces of the magnetized strips and the diaphragm. The magnetized strips adjacent each other, but not of the same functional pair, are of like polarity at their front faces as to produce a substantially neutral zone or dead zone without magnetic field, as at the space 96.

In the transducer 90, the conductors on the diaphragm are arranged in wide band runs 97 traversing the entire widths of functional pairs of magnetized strips and the spaces therebetween. The fields are flattened because of the opposed magnetic backings, to optimize the forces applied to the diaphragm.

FIG. 13 illustrates that the transducer 98 may have an oval shape with substantially all of the remaining characteristics of the transducer 10 of FIGS. 1 and 2. In FIG. 14, the transducer 99 is illustrated in a round shape, also incorporating substantially all of the features of the transducer 10. It will be recognized that the conductor runs 98.1 and 99.1 of the two transducers 98 and 99 vary slightly in length relative to each other to accommodate the curved periphery of the vibratable area.

Figure 15:
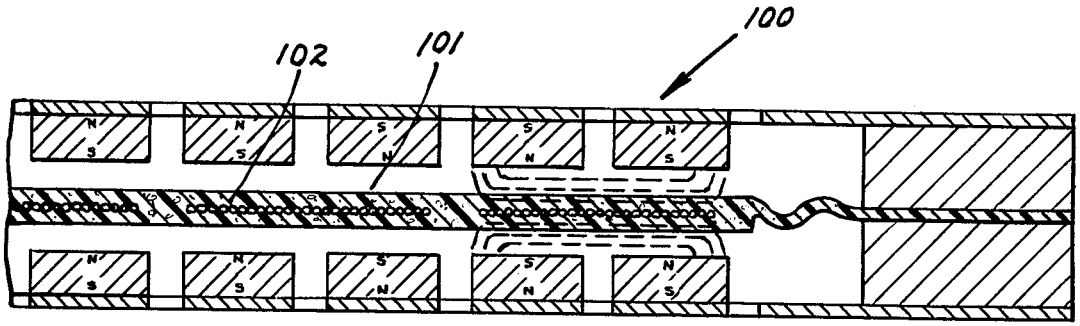
FIG. 15 is a detail section view of still another modified form of the invention.

In FIG. 15, the transducer 100 is very similar to the transducer 90 illustrated in FIG. 12, with the exception that the transducer 100 has the stiff or substantially rigid vibratable area 101 of the diaphragm formed with the conductor runs 102 embedded therein. The vibratable area of the diaphragm may be integrally molded with the conductor runs originally formed therein, and as indicated previously, the vibratable area 101 of the diaphragm may be typically formed of styrofoam.

Although all of the stiff diaphragms herein disclosed are connected to the peripheral frame strip and backing with a flexible surround, other devices may be used to hold the stiff diaphragm in predetermined relation to the magnetic strips while allowing the diaphragm to vibrate without substantial flexing. For instance, the diaphragm may have bearing apertures at its corners to receive stationary mounting posts upon which the diaphragm is free to slide; and the periphery of the stiff diaphragm may be free of the frame strips, while guided close to the frame strips, preferably but not necessarily in substantially air sealing relation. Also flexible links may attach the frame strips to the diaphragm to retain the diaphragm in alignment with the magnetized strips, without such posts.

Figure 16:
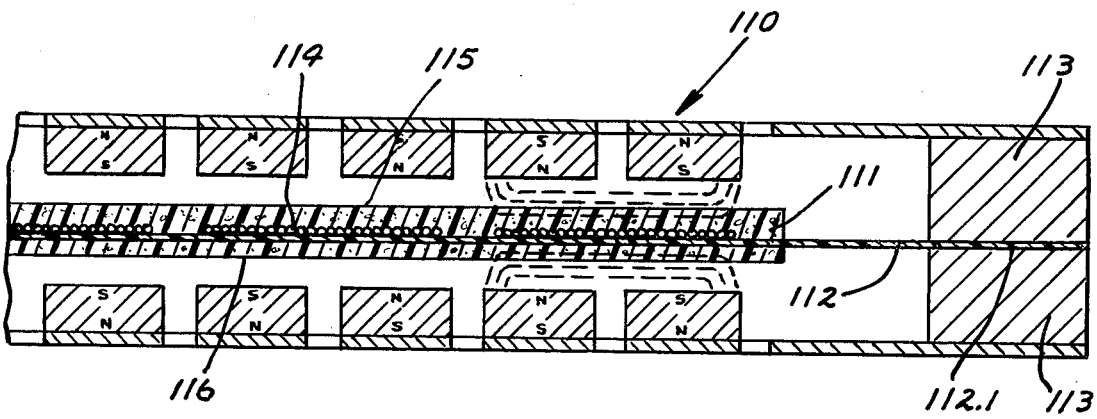
FIG. 16 is a detail section view of still another modified form of the invention.

The transducer 110 of FIG. 16 is very similar to the transducer 90 of FIG. 12 with the exception that the transducer has the diaphragm 111 formed on a film 112 as the base of the diaphragm providing connection at the outer periphery 112.1 to the frame strips 113 of the transducer. The film 112 may be formed of any of a number of materials such as polyester film, known as Mylar, with a thickness in the range of 0.000250 inches to 0.005 inches. The conductor runs 114 are laid upon the film diaphragm 112; and a stiff or substantially rigid panel 115 of styrofoam or other similar plastic material, overlays the conductor runs 114 and is adhered to the film diaphragm 112. The stiff panel 115 provides the stiff vibratable area of the diaphragm; and an optional additional panel 116 may be adhered to the opposite side of the flexible diaphragm 112 to cooperate with the panel in adding stiffness. In this form, application of a signal current produces substantial movement of the whole diaphragm because of the stiffness added by panels 115 and 116. However, limited flexing of these panels is also experienced.

Figure 17:
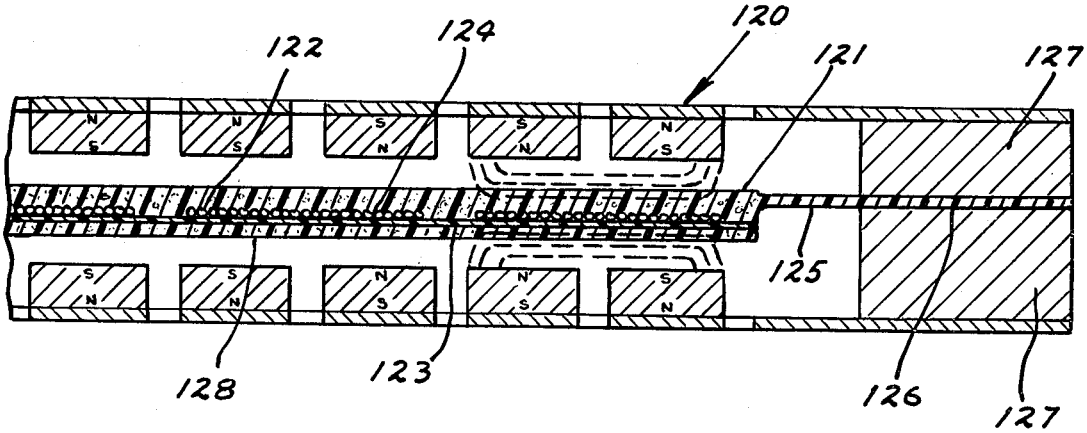
FIG. 17 is a detail section view of one more modified form of the invention.

The transducer 120 of FIG. 17 is substantially similar to the transducer 90 of FIG. 12 with the exception of the diaphragm 121 which has a stiff panel 122 of styrofoam or other stiff material, against which a panel 123 of Mylar or other flexible film type plastic material, is laid and adhered to. The conductor runs 124 are sandwiched between the stiff panel 122 and the film panel 123 and are substantially embedded in the stiff panel 122. The stiff panel 122 has a flat marginal connecting panel 125 and a peripheral edge portion 126 which is secured to the frame strips 127 of the transducer. An optional additional stiff or substantially rigid panel 128 may be adhered to the film panel 123 to sandwich the film panel between the two stiff panels 122, 128, for adding additional stiffness. As in the transducer 110 of FIG. 16, the diaphragm 121 of the transducer 120 moves significantly over its length and breadth when signal current is applied to the conductor runs, however, there is some limited flexing whereby the central portions of the diaphragm have some greater excursion than the peripheral portions.

FIG. 18 illustrates a modified form of magnet structure which may be used in any of the disclosed forms of transducer. The magnet structure 130 is in sheet or panel form and may be molded or die cut to the shape illustrated. The magnet structure is formed of the same material as described for strips 15 of FIGS. 1–2. A number of slots 131 are formed to define spaces between the magnetized strips 132. The slots will align with the apertures in the iron or steel panel of the magnetic backing. Narrow bridges 133 traverse the slots and interconnect adjacent strips 132. The magnetized strips may be magnetized with magnetic poles at their front faces as indicated or otherwise according to the magnetic circuit desired.

It will be seen that the transducers of the present invention incorporate a substantially rigid vibratable area of a diaphragm formed of a low density material which has a high degree of stiffness to weight ratio. The conductor runs are spread across substantially the entire length or breadth of the vibratable area and extend substantially throughout the length of the vibratable area so that substantially all portions of the vibratable areas have substantially the same motion. The flexible surround at the periphery of the vibratable area, accommodates the substantially uniform vibrating movement across the whole length and breadth of the vibratable area.

What is claimed is:

1. A transducer for carrying a signal current, comprising a generally flat and rigid acoustically transparent magnetic backing including a multiplicity of elongate magnetized strips lying along each other in spaced relation to each other, the magnetized strips being magnetized in a direction perpendicular to the backing, adjacent magnetized strips being oppositely polarized and having magnetic poles of opposite polarity at the front faces thereof for projecting a magnetic field outwardly from the front faces, and a diaphragm having a vibratable area confronting the front faces of the magnetized strips in spaced relation therewith, the vibratable area having signal carrying conductor runs thereon and extending along the magnetized strips, the vibratable area of the diaphragm being stiff to resist flexing relative to both the length and breadth of the diaphragm, and connecting means for connecting the diaphragm to the backing to permit the entire vibratable area of the diaphragm to vibrate under influence of the magnetic fields and the signal currents in the conductor runs.

2. The transducer according to claim 1 and the connecting means being flexible and formed integrally with the vibratable area of the diaphragm.

3. The transducer according to claim 2 and a stiffening panel adhered to the vibratable area of the diaphragm.

4. The transducer according to claim 1 and the connecting means being flexible and of a different material than the vibratable area of the diaphragm and being secured to said vibratable area.

5. The transducer according to claim 4 and the vibratable area including a stiff panel carrying the conductors and said connector means comprising a film plastic membrane secured to the vibratable area of the diaphragm and connected with said magnetic backing.

6. The transducer according to claim 1 wherein the vibratable area of the diaphragm has elongate ribs extending thereacross and stiffening the vibratable area.

7. The transducer according to claim 6 and the conductor runs being embedded in the ribs on the diaphragm.

8. The transducer according to claim 1 wherein said conductor runs are on the surface of the vibratable area of the diaphragm and secured thereto.

9. The transducer according to claim 1 and said conductor runs being embedded in the vibratable area of the diaphragm.

10. The transducer according to claim 1 and each of the conductor runs having a multiplicity of conductor strands clustered together in wide runs confronting and traversing oppositely polarized magnetic strips and the magnetic field emanating therefrom.

11. A transducer for carrying a signal current, comprising a generally flat and rigid acoustically transparent magnetic backing including a multiplicity of elongate magnetized strips lying along each other in spaced relation to each other, the magnetized strips being magnetized in a direction perpendicular to the backing, adjacent magnetized strips being oppositely polarized and having magnetic poles of opposite polarity at the front faces thereof for projecting a magnetic field outwardly from the front faces, and a diaphragm having a vibratable area confronting the front faces of the magnetized strips in spaced relation therewith, the vibratable area having signal carrying conductor runs thereon and extending along the magnetized strips, each of the conductor runs includes a plurality of conductor strands arranged in stacked relation to each other on the vibratable area of the diaphragam, the vibratable area of the diaphragm being stiff to resist flexing, and connecting means for connecting the diaphragm to the backing to permit the entire vibratable area of the diaphragm to vibrate under influence of the magnetic fields and the signal currents in the conductor runs.

12. A transducer for carrying signal current, comprising a generally flat and rigid acoustically transparent magnetic backing having a multiplicity of magnetized strips in spaced relation to each other, the magnetized strips having front faces lying substantially in a plane and the strips being magnetized in a direction substantially perpendicular to the front faces of the strips, adjacent magnetic strips being oppositely polarized and having magnetic poles of opposite polarity at the front faces thereof for projecting elongate magnetic fields outwardly from said front faces, and a diaphragm having a vibratable area confronting the front faces of the magnetized strips in spaced relation therewith, the vibratable area having a multiplicity of signal carrying conductor runs thereon and extending along the magnetized strips, the diaphragm also having a connecting area connecting the periphery of the diaphragm with the magnetic backing, the vibratable area being significantly stiffer in all directions than the connecting area whereby the connecting area flexes to permit the entire vibratable area to vibrate under influence of the magnetic fields and the signal current in the conductor runs.

13. The transducer according to claim 12 wherein said conductor runs include conductor strands secured to the vibratable area as to contribute materially to the stiffness of the vibratable area.

14. The transducer according to claim 12 wherein the magnetic backing includes an acoustically transparent soft iron plate against which said magnetized strips lie.

15. A transducer for carrying a signal current, comprising a pair of generally flat and rigid acoustically transparent magnetic backings each including a multiplicity of elongate magnetized strips lying along each other in spaced relation to each other, the magnetized strips having front faces lying substantially in a plane and the magnetized strips being magnetized in a direction perpendicular to the front faces, adjacent magnetized strips being oppositely polarized and having magnetic poles of opposite polarity at the front faces thereof for projecting a magnetic field outwardly from the front faces, said pair of magnetic backings being arranged in opposed relation to each other with magnetized strips of like polarities being directly opposite each other and in spaced relation to each other, and a diaphragm having a vibratable area between the magnetic backings and in spaced relation with the front faces of the magnetized strips, the vibratable area having signal carrying conductor runs thereon and extending along the magnetized strips and the magnetic fields projecting therefrom, the vibratable area of the diaphragm being stiff to resist flexing along and transverse to the conductor runs, and the diaphragm also having means connecting the vibratable area to the backing to permit the entire vibratable area of the diaphragm to vibrate under influence of the magnetic fields and signal currents in the conductor runs.

16. The transducer according to claim 15 and each of the conductor runs including a multiplicity of conductor strands clustered into wide bands confronting and traversing the front faces of adjacent oppositely polarized magnetized strips and the magnetic fields emanating therefrom.

17. A transducer for carrying a signal current, comprising a pair of generally flat and rigid acoustically transparent magnetic backings each including a multiplicity of elongate magnetized strips lying along each other in spaced relation to each other, the magnetized strips having front faces lying substantially in a plane and the magnetized strips being magnetized in a direction perpendicular to the front faces, adjacent magnetized strips being oppositely polarized and having magnetic poles of opposite polarity at the front faces thereof for projecting a magnetic field outwardly from the front faces, said pair of magnetic backings being arranged in opposed relation to each other with magnetized strips of like polarities being directly opposite each other and in spaced relation to each other, and a diaphragm having a vibratable area between the magnetic backings and in spaced relation with the front faces of the magnetized strips, the vibratable area having signal carrying conductor runs thereon and extending along the magnetized strips and the magnetic fields projecting therefrom, each of the conductor runs including a multiplicity of conductor strands stacked upon each other on the diaphragm and adhered together with the effect of strengthening ribs contributing to the stiffness of the vibratable area as to cause the entire vibratable area to vibrate with substantially the same motion, the vibratable area of the diaphragm being stiff to resist flexing, and having means connecting the vibratable area to the backing to permit the entire vibratable area of the diaphragm to vibrate under influence of the magnetic fields and signal currents in the conductor runs.

18. The transducer according to claim 15 and the conductor runs being embedded in the vibratable area of the diaphragm.

19. The transducer according to claim 15 and the vibratable area of the diaphragm having opposite sides respectively facing the magnetic backings, said conductor runs being disposed on both sides of the diaphragm and respectively confronting adjacent front faces of the magnetized strips.

20. The transducer according to claim 15 wherein the magnetized strips also being arranged with alternate magnetized strips being of like polarity at their front faces.

21. A transducer for carrying a signal current, comprising a pair of generally flat and rigidly acoustically transparent magnetic backings including a multiplicity of elongate magnetized strips lying along each other in spaced relation to each other and having elongate front faces lying substantially in a plane, the magnetized strips being magnetized in a direction perpendicular to the front faces, the magnetized strips being arranged with the magnetic poles at their front faces having a sequence, to wit, north, south, south, north, north, south, et seq, for projecting magnetic fields outwardly from the front faces entirely across the width of adjacent front faces of opposite polarity, and the pair of magnetic backings being arranged in confronting relation with each other and with magnetized strips of like polarity disposed in directly opposed relation to each other whereby the magnetic fields between the backings are compressed and have lines of magnetic flux extending substantially parallel with the front faces of said strips, and a diaphragm having a vibratable area with length and breadth and disposed between the magnetic backings and confronting the front faces of the magnetized strips in spaced relation therewith, the vibratable area having a multiplicity of signal carrying conductor runs each including a multiplicity of conductor strands clustered in wide flat runs confronting and transversing substantially the entire width of magnetized strips of opposite polarity and the space therebetween, the vibratable area of the diaphragm being stiff in the direction of both the length and breadth to resist flexing and having flexible means for connecting the periphery of the vibratable area to the backings to permit the entire vibratable area of the diaphragm to vibrate with substantially the same motion under influence of the magnetic fields and the signal currents in the conductor runs, whereby to accommodate increased power handling capabilities of the transducer and to significantly increase the magnitude of sound output in the bass frequencies.

22. The transducer according to claim 21 wherein the conductor strands have a configuration substantially flat and parallel with the vibratable area of the diaphragm.

23. The transducer according to claim 1 wherein the vibratable area of the diaphragm is formed of styrofoam.

24. The transducer according to claim 1 wherein the vibratable area of the diaphragm is formed of a honeycombed structure with open cells therein.

25. The transducer according to claim 1 wherein the vibratable area of the diaphragm is formed of multiple laminations of high strength low density material.

26. The transducer according to claim 1 wherein the vibratable area of the diaphragm is formed of fibrous pulp material.

27. The transducer according to claim 1 wherein the vibratable area of the diaphragm is formed with carbon fiber materials.

28. The transducer according to claim 1 wherein the vibratable area of the diaphragm is formed of predominently balsa wood.

* * * * *

UNITED STATES PATENT AND TRADEMARK OFFICE

CERTIFICATE OF CORRECTION

PATENT NO. : 4,471,173

DATED : September 11, 1984

INVENTOR(S) : James M. Winey

It is certified that error appears in the above-identified patent and that said Letters Patent are hereby corrected as shown below:

Column 13, line 12, delete "transversing" and substitute --traversing--.

Signed and Sealed this

*Fourth* Day of *June 1985*

[SEAL]

*Attest:*

DONALD J. QUIGG

*Attesting Officer* *Acting Commissioner of Patents and Trademarks*